United States Patent [19]

Hafner et al.

[11] 4,455,982

[45] Jun. 26, 1984

[54] ELECTROMAGNETICALLY ACTUATABLE VALVE

[75] Inventors: Udo Hafner, Lorch; Waldemar Hans, Bamberg, both of Fed. Rep. of Germany

[73] Assignee: Robert Bosch GmbH, Stuttgart, Fed. Rep. of Germany

[21] Appl. No.: 415,949

[22] Filed: Sep. 8, 1982

[30] Foreign Application Priority Data

Mar. 5, 1982 [DE] Fed. Rep. of Germany ..... 3207919

[51] Int. Cl.[3] ..... F02M 51/08

[52] U.S. Cl. ..... 123/472; 239/585; 239/533.2

[58] Field of Search ..... 123/472, 41.31; 251/137, 285; 239/585, 533.2, 533.3, 533.12, 139, 87, 128, 132, 132.5

[56] References Cited

U.S. PATENT DOCUMENTS

| | | | |
|---|---|---|---|
| 3,644,076 | 2/1972 | Bagge | 239/132.3 |
| 3,731,876 | 5/1973 | Showalter | 239/533.2 |
| 4,292,947 | 10/1981 | Tanasawa et al. | 123/472 |
| 4,351,480 | 9/1982 | Masaki et al. | 239/585 |
| 4,365,747 | 12/1982 | Knapp et al. | 239/585 |
| 4,387,677 | 6/1983 | Guerrier | 123/472 |
| 4,390,130 | 6/1983 | Linssen et al. | 239/585 |

*Primary Examiner*—Raymond A. Nelli
*Attorney, Agent, or Firm*—Edwin E. Greigg

[57] ABSTRACT

An electromagnetically actuatable fuel injection valve for delivering fuel in internal combustion engines comprises a valve casing and an electromagnet core on which a coil carrier carrying a solenoid winding is mounted. The fuel inflow via the feed pipe can be directed past the armature and ejected via the valve seat, fuel passage and preparation bore. The solenoid wind is disposed in the interior cavity of the valve casing in such a manner that fluid can circulate thereabout. A blind bore in the valve casing serves as an accumulator for vapor-bubbles in the fuel which may flow back to the feed pipe via an exhaust line which connects with an annular groove and an exhaust outlet.

4 Claims, 1 Drawing Figure

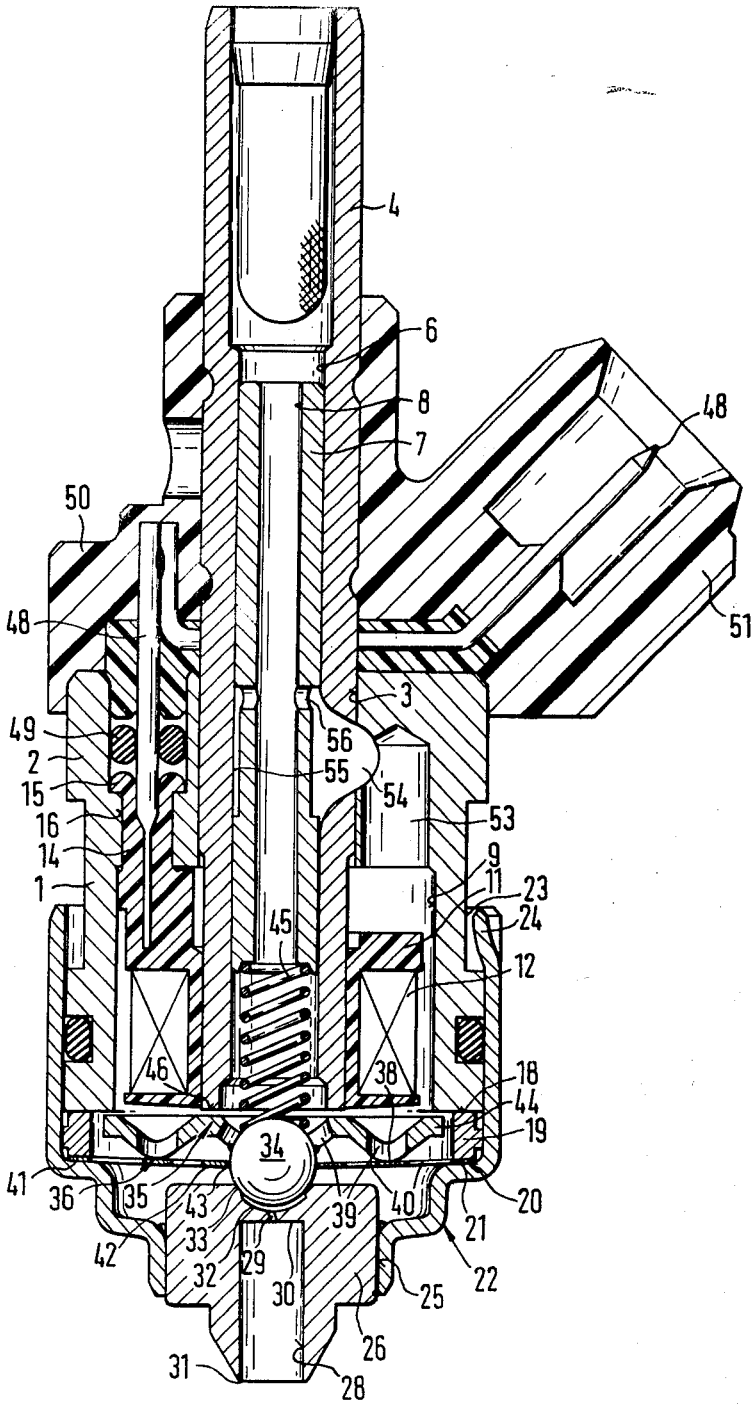
4
6
8
7
48
50
48
51
3
49
56
2
55
15
54
16
53
14
9
1
11
23
24
45
12
46
38
18
44
19
34
41
36
35
43
39
40
20
21
42
33
32
29
30
25
22
26
31
28

ELECTROMAGNETICALLY ACTUATABLE VALVE

BACKGROUND OF THE INVENTION

The invention relates to improvements in electromagnetically actuatable valves for fuel injection systems wherein a vapor bubble exhaust line is provided. Fuel-injection valves typically pose the danger of allowing vapor bubbles to proceed to injection with the fuel, resulting potentially in engine combustion interference and difficulties in starting the engine. To avoid corrosion, it is also desirable that no excess fluid stagnate in the valve. There is known a fuel injection valve which provides for back-flushing of the valve via a reverse flow line. Such a construction, however, requires the provision of an additional fuel connection on the valve for the reverse flow line which can result in an excessive supply of fuel over what the engine requires for optimum combustion. This application discloses a further improvement in electromagnetically actuatable valves to that being filed concurrently herewith in the name of Udo Hafner et al, both applications being owned by the same assignee.

OBJECT AND SUMMARY OF THE INVENTION

The valve with its marked characteristics disclosed hereinafter has the advantage over the prior art that it is possible by simple means and without provision of an additional reverse flow line to remove existing vapor bubbles from the valve. The invention will be better understood and further objects and advantages thereof will become more apparent from the ensuing detailed description of a preferred embodiment taken in conjunction with the drawing.

BRIEF DESCRIPTION OF THE DRAWING

The drawing is a simplified representation, in partial section, of an exemplary embodiment of the invention, which is described in more detail hereinafter.

DESCRIPTION OF THE EXEMPLARY EMBODIMENT

The exemplary embodiment of an electromagnetically actuatable fuel injection valve for a fuel injection system, which valve is shown in the drawing, may be used, for example, for injecting fuel into the intake tube of a mixture-compressing internal combustion engine with externally supplied ignition. The valve casing 1, produced with a stress-free forming operation, such as deep drawing, rolling, or the like, is cup-shaped and includes a bottom portion 2. A fuel pipe 4, having the form of a connecting piece or union, is inserted in a cylindrical holding opening 3 in the bottom portion 2 so as to form a tight seal. Pipe 4 is comprised of a ferromagnetic material, and serves as the interior core of the electromagnetically actuatable valve, as well as the fuel pipe, the axis of pipe 4 coinciding with the axis of the valve. An adjustable bushing 7, preferably comprising a second pipe having a bore hole 8 extending throughout its length, is pushed into the interior bore hole 6 of said fuel pipe 4. The end of pipe 4 which extends outside the valve casing 1 is in communication with a source of fuel, for example a fuel intake manifold. The other end 10 of pipe 4, extends into an interior cavity 9 of valve casing 1 and supports an insulating coil carrier 11 which at least partially surrounds a solenoid winding 12. The coil carrier 11 and the solenoid winding 12 are axially fixed in a fastening bore hole 16 in the bottom portion 2 by means of a guide pin 14 having a bead or snap fastening 15. A spacing ring 19 presses against the end face 18 of the valve casing 1, which end face faces away from the bottom portion 2, and a guide membrane 20 adjoins the spacing ring. The side of guide membrane 20 opposite ring 19 engages a shoulder 21 of a nozzle carrier 22 which partially surrounds the valve casing 1. One end of the nozzle carrier 22 has a portion 24 bent into a holding groove 23 of valve casing 1, so that an axial tension force is provided for holding the spacing ring 19 and guide membrane 20 in place. The opposite end of nozzle carrier 22 defines a coaxial cylindrical space 25 for accepting a nozzle element 26 into the space with both the space and the nozzle being directed away from the valve casing 1. The nozzle element is attached to the nozzle carrier by such means as, for example, welding or brazing, and includes a preparation bore 28 having the general shape of a blind-end bore with a bottom 30 having at least one fuel passage 29 opening thereinto and serving to supply the metered amount of fuel. The relationship between the fuel passage 29 and the bottom 30 of the preparation bore 28 is preferably that there is no tangentially directed flow into bore 28, but the fuel jet exits from the fuel passage or passages 29 without initially contacting the walls of the preparation bore 28. Thereafter the fuel jet impinges on the walls of the preparation bore, dispersing with film formation so that a film of approximately parabolic shape is developed, whereby the fuel moves toward the open end 31 of preparation bore 28 and breaks away therefrom. Each fuel passage 29 is disposed at an angle to the valve axis, and extends between a cup-shaped space 32, which is formed in the nozzle element 26, and the preparation bore 28. The nozzle element also includes an arcuate valve seat 33, which cooperates with a spherical valve head or valve part 34. In order to minimize dead space, the volume of the cup-shaped space 32 is preferably designed to be as small as possible when the valve head 34 abuts against the valve seat 33.

Valve head 34 is connected on its side facing away from valve seat 33 to a flattened, plate-like armature 35 of radially-corrugated, cylindrical shape. This connection may be accomplished, for example, by brazing or soldering. The armature 35 may be formed by stamping or pressing, and may have, for example, a ring-shaped guide section 36 in the form of a raised area which presses against a ring-shaped guide region 38 on the side of membrane 20 which faces away from the valve seat 33. Flow openings 39 in the armature 35 and flow ports 40 in the guide membrane 20 allow the fuel to flow unhindered through the armature 35 and the guide membrane 20. Guide membrane 20 is attached to the casing by compression in a compression region 41 on the outer circumference of the membrane lying between the spacing ring 19 and the shoulder 21. Membrane 20 has a centering region 42 surrounding a centering opening 43 through which the movable valve head 34 extends and by which the valve head 34 is radially centered. The plane in which guide membrane 20 is compressed to affix it to the casing between the spacing ring 19 and the shoulder 21 runs through, or as closely as possible to, the center of the spherical valve head 34 when said valve head is pressed against the valve seat 33. The guide region 38 of guide membrane 20 engages guide section 36 of armature 35 so as to guide the armature in such as manner as to keep it as parallel as possible to the end surface 18 of valve casing 1. Outer operating region 44 of armature 35 partially radially overlaps the end face 18. A compression spring 45 is contained in the interior bore 6 of the end of fuel pipe 4, the latter extending almost down to armature 35 and serving as the interior core 10 of the electromagnet. One end of the spring engages the valve head 34 and the other end engages adjustable bushing 7. The spring is thus arranged to push valve head 34 in the direction of valve seat 33. The end of fuel pipe 4 which serves as the interior core of the electromagnet is inserted in the valve casing 1 to the point where there is a small air gap between the end face 46 of said pipe which faces the armature 35 and the armature itself. This air gap exists when the solenoid winding 12 is energized and causes the outer operating region 44 of the armature to rest against end face 18 of valve casing 1, as well as when the solenoid winding 12 is not energized, wherein the armature assumes a position in which an air gap is also formed between the end face 18 and the operating region 44. In this way the armature is prevented from sticking to the interior core of fuel pipe 4. After the necessary air gap is set, the fuel pipe 4 is advantageously brazed or soldered to the bottom portion 2 of the casing. The magnetic circuit extends externally over the valve casing 1 and internally over the fuel pipe 4, and is closed via armature 35.

Current is supplied to solenoid winding 12 via contact lugs 48, which have the plastic coil carrier 11 partly injection-molded around them, and extend out from casing 1 on the other side via fastening holes 16 in the bottom portion 2. In this way, the contact lugs can run at an angle to the valve axis, as shown. The contact lugs 48, which are partially sheathed in the region of the guide pins 14 of the coil carrier 11, are encircled by sealing rings 49 for sealing the fastening holes 16. A plastic cap 50 is injection molded around, and at least partially envelops, the contact lugs 48 along with the fuel pipe 4 and the bottom portion 2. The cap is also formed as a plug connector 51 in the region region of the ends of the contact lugs 48.

The fuel supplied through the fuel pipe 4 is delivered in metered amounts to fuel passages 29 upon actuation of the hollow solenoid winding 12 and displacement of the flattened armature 35, the fuel being expelled via the preparation bore 28 for injection.

After shut-off of the internal combustion engine there is a specific danger of heat transferred by the engine to the injection valves resulting in the vaporization of fuel in the valves and fuel passages, possibly causing interference at a repeat start of the engine. Thus, the instant invention provides for a blind bore 53 openly disposed on the bottom portion 2 of the valve casing 1 in the direction of the interior cavity 9 of the valve casing 1, where vapor-bubbles can accumulate and then escape to a ring groove 55 which is provided in the jacket surface of the adjustable bushing 7. It will be noted that the ring groove 55 in the adjustable bushing 7 has a zone which is contiguous with a bulged means defining an opening 54 in the wall of pipe 4 and, further, this opening communicates with the blind bore 53.

Exhaust or degassing outlets 56 are provided in the wall of the adjustable bushing. These outlets 56 are radially disposed and thus communicate with ring groove 55 which leads to the bore hole 8 of the adjustable bushing. The blind bore 53 which connects with the opening 54, ring groove 55 and exhaust outlets 56 thus form an exhaust line by which the vapor bubbles can escape from the interior cavity 9 of the valve casing 1 to the fuel-pipe 4 and furthermore are sufficiently removed from the valve seat 33. The bulged opening 54 is partially disposed in the fuel-pipe 4 and bottom portion 2 of the valve casing is preferably provided by means of a known electro-erosive abrasion method with an abraded surface after the fuel-pipe 4 is mounted in the bottom portion 2 of the valve casing 1.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An electromagnetically actuatable valve, particularly a fuel injection valve for a fuel injection system in an internal combustion engine, comprising a valve casing, a fuel pipe comprised of an electromagnet core of ferromagnetic material extending into the interior cavity of the valve casing, a solenoid winding disposed on said core, said winding mounted in said casing so that fluid can circulate thereabout, an armature and guide means arranged to actuate a valve element positioned in a valve seat in said valve casing, characterized in that said interior cavity of said valve casing further includes at least one means providing an exhaust line which faces in the opposite direction from said valve seat and said exhaust line is in communication with means defining an opening in said fuel pipe.

2. The valve as set forth in claim 1, characterized in that said fuel pipe has an interior wall providing means to support an adjustable bushing having at least one exhaust outlet in communication with said cavity.

3. The valve as set forth in claim 2, characterized in that said valve casing is substantially cup-shaped and further that said means providing an exhaust line is formed as a bore in said cup-shaped valve casing.

4. The valve as set forth in claim 1, characterized in that said means defining an opening in said fuel pipe is formed by electromechanical machining.

* * * * *